US006662861B2

(12) United States Patent
Ozaki et al.

(10) Patent No.: US 6,662,861 B2
(45) Date of Patent: Dec. 16, 2003

(54) HEAT EXCHANGER

(75) Inventors: Tatsuo Ozaki, Okazaki (JP); Satomi Muto, Nishi Kasugai-gun (JP); Takaaki Sakane, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/929,635

(22) Filed: Aug. 14, 2001

(65) Prior Publication Data

US 2002/0017381 A1 Feb. 14, 2002

Related U.S. Application Data

(63) Continuation of application No. PCT/JP00/08827, filed on Dec. 13, 2000.

(30) Foreign Application Priority Data

Dec. 14, 1999 (JP) ..... 11-354819

(51) Int. Cl.[7] ..... F28F 13/00
(52) U.S. Cl. ..... 165/140; 165/135
(58) Field of Search ..... 165/140, 135, 165/151–153

(56) References Cited

U.S. PATENT DOCUMENTS

| | | | | | |
|---|---|---|---|---|---|
| 1,557,467 | A | * | 10/1925 | Modine | 165/151 |
| 3,298,432 | A | * | 1/1967 | Przyborowski | 165/153 |
| 3,437,134 | A | * | 4/1969 | Oddy | 165/151 |
| 4,328,861 | A | * | 5/1982 | Cheong et al. | 165/151 |
| 4,984,626 | A | * | 1/1991 | Esformes et al. | 165/151 |
| 5,076,353 | A | * | 12/1991 | Haussmann | 165/151 |
| 5,251,692 | A | * | 10/1993 | Haussmann | 165/152 |
| 5,360,060 | A | * | 11/1994 | Tanaka et al. | 165/151 |
| 5,752,567 | A | * | 5/1998 | Obosu | 165/151 |
| 5,992,514 | A | | 11/1999 | Sugimoto et al. | |
| 6,170,565 | B1 | * | 1/2001 | Nishishita | 165/140 |
| 6,357,518 | B1 | * | 3/2002 | Sugimoto et al. | 165/140 |

FOREIGN PATENT DOCUMENTS

| | | |
|---|---|---|
| EP | 0 677 716 A1 | 4/1995 |
| JP | A 61-59195 | 3/1986 |
| JP | A 63-14092 | 1/1988 |
| JP | U 2-14582 | 1/1990 |
| JP | A 6-147785 | 5/1994 |
| JP | A 10-009783 | 1/1998 |
| JP | A 11-142079 | 5/1999 |

* cited by examiner

*Primary Examiner*—Leonard Leo
(74) *Attorney, Agent, or Firm*—Harness, Dickey & Pierce, PLC

(57) ABSTRACT

Waved uneven portions (112*f*, 122*f*) are formed on the protrusion portions (112*e*, 122*e*) of the fins (112, 122) protruded from an end of the tubes (111, 121) in the width direction of the tube without cutting part of the protrusion portions (112*e*, 122*e*) to increase the surface area of the fins (112, 122). As a result, the surface area of the protrusion portions (112*e*, 122*e*) may be increased without decreasing the thermal conductive area extending to the end of the protrusion portions (112*e*, 122*e*), and thereby a sufficient amount of heat may be conducted especially to the protrusion portions (112*e*, 122*e*), with decreasing airflow resistance, and an improvement in radiation ability appropriate to the increase of radiation area may, accordingly, be achieved.

5 Claims, 11 Drawing Sheets

HEAT EXCHANGER

CROSS-REFERENCE TO RELATED APPLICATION

This application is based upon and claims priority from Japanese Patent Application No. 11-354819, filed Dec. 14, 1999, and is a continuation of PCT/JP008827, filed Dec. 13, 2000.

FIELD OF THE INVENTION

The present invention relates to a heat exchanger, particularly to a duplex heat exchanger in which a radiator and a condenser for a vehicle are integrated.

BACKGROUND OF THE INVENTION

According to the invention proposed in Japanese Unexamined Patent Publication 10-231724, for example, the cooling fins of the heat exchanger have a protrusion portion protruded from an end of the tube in the width direction of the tube to the direction perpendicular to the longitudinal direction of the tubes to increase the radiation area, thus improving the radiation ability of the heat exchanger. The width direction of the tube is a direction perpendicular to the longitudinal direction of the tube.

As is well known, the louvers on the cooling fin (called a fin hereinafter) are formed in louver board style by cutting and setting up part of the fin, and disturb the airflow around the fin to suppress growth of the temperature boundary layer, thereby improving the heat transfer coefficient between the airflow and the fin. However, since the louvers disturb the airflow, the resistance to the airflow passing through the heat exchanger may be increased.

In addition, since the louver is formed by cutting and setting up part of the fin, the thermal conductive area of the fin extending to the end of the protrusion portion is decreased, and thereby a sufficient amount of heat may not be conducted from the tube to the fin, and the improvement in radiation ability appropriate to the increase in radiation area may, accordingly, not be achieved.

DISCLOSURE OF THE INVENTION

It is therefore an object of the invention to improve the heat exchanging ability of a heat exchanger having fins protruded from an end of the tube in the width direction thereof.

In order to achieve the above object, a heat exchanger according to the present invention comprises a plurality of tubes (111, 121) in which fluid flows and which extend to the direction perpendicular to the direction of airflow, and fins (112, 122) which are provided on the outer surface of the tubes (111, 121) to accelerate the heat exchange between air and the fluid, wherein the fins (112, 122) have protrusion portions (112*e*, 122*e*) protruded from an end of the tubes (111, 121) in the width direction of the tube to the direction perpendicular to the longitudinal direction of the tubes (111, 121), and uneven portions (112*f*, 122*f*) are formed on the protrusion portions (112*e*, 122*e*), without cutting part of them, to increase the surface area of the fins (112, 122).

In this embodiment, the surface area of the protrusion portions (112*e*, 122*e*) may be increased without decreasing the thermal conductive area extending to the end of the protrusion portions (112*e*, 122*e*), and thereby a sufficient amount of heat may be conducted from the tubes (111, 121) to the fins (112, 122), especially to the protrusion portions (112*e*, 122*e*), and the improvement of radiation ability appropriate to the increase of radiation area may be achieved accordingly In addition, the uneven portions (112*f*, 122*f*) do not disturb the airflow as much as the louvers because the uneven portions are not formed by cutting part of the fins in contrast to the louvers, thus decreasing the airflow resistance more than the louver. Although the heat transfer coefficient of the protrusion portions (112*e*, 122*e*) may be lower than that in case that the louvers are provided, the surface area of the protrusion portions (112*e*, 122*e*) are increased without decreasing the thermal conductive area of the protrusion portions (112*e*, 122*e*), and the air volume is increased due to the decrease of airflow resistance, and thereby the radiation ability may be improved, Another embodiment of the present invention comprises a plurality of tubes (111, 121) in which fluid flows and which extend to the direction perpendicular to the direction of airflow, and fins (112, 122) which are provided on the outer surface of the tubes (111, 121) to accelerate the heat exchange between air and the fluid, and on which louvers (112*d*, 122*d*) are formed in louver board style by cutting and setting up part of the fins (112, 122), wherein the fins (112, 122) have protrusion portions (112*e*, 122*e*) protruded from an end of the tubes (111, 121) in the width direction of the tube to the direction perpendicular to the longitudinal direction of the tubes (111, 121), and the louvers (112*d*, 122*d*) formed on the protrusion portions (112*e*, 122*e*) are different from the louvers (112*d*, 122*d*) formed on the other portions than the protrusion portions (112*e*, 122*e*) of the fins (112, 122).

In this embodiment, the airflow resistance of the protrusion portions may be decreased, and the improvement in radiation ability appropriate to the increase of radiation area may be achieved accordingly.

The heat exchanger of another embodiment of the present invention is a duplex heat exchanger comprising a first heat exchanger (110) which is a heat exchanger according to the present invention, and a second heat exchanger (120) which is a heat exchanger according to the present invention arranged in series with the first heat exchanger (110) in the direction of airflow, wherein the protrusion portions (112*e*) of the first heat exchanger (110) are protruded to the second heat exchanger (120), and the protrusion portions (122*e*) of the second heat exchanger (120) are protruded to the first heat exchanger (110).

The present invention will be more fully understood in conjunction with the accompanying drawings and the descriptions of the preferred embodiments of the present invention.

PREFERRED EMBODIMENT OF THE PRESENT INVENTION

The First Embodiment

Figure 1:
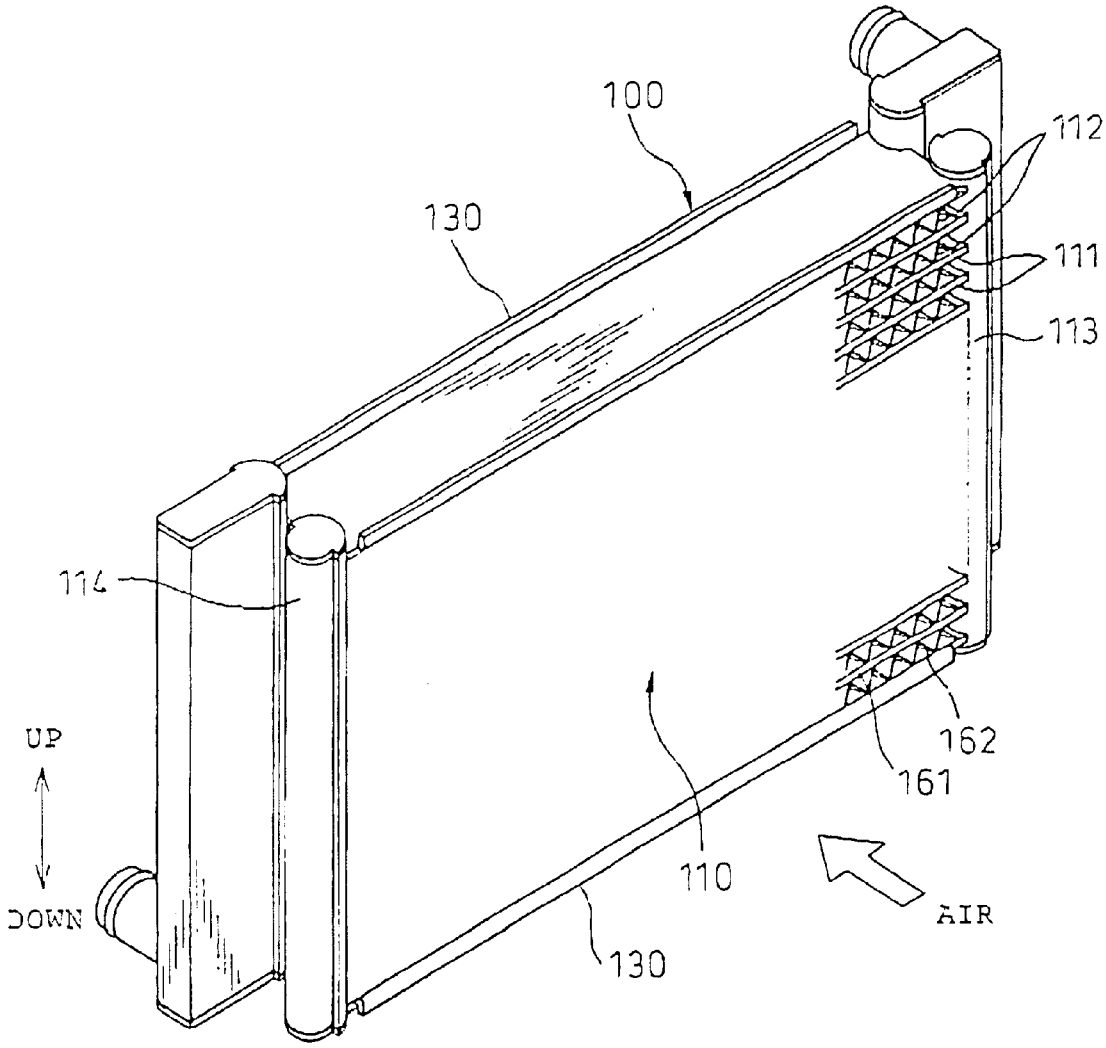
FIG. 1 is a perspective view of the duplex heat exchanger of the first embodiment of the present invention viewed from the upstream side of the airflow.
Figure 2:
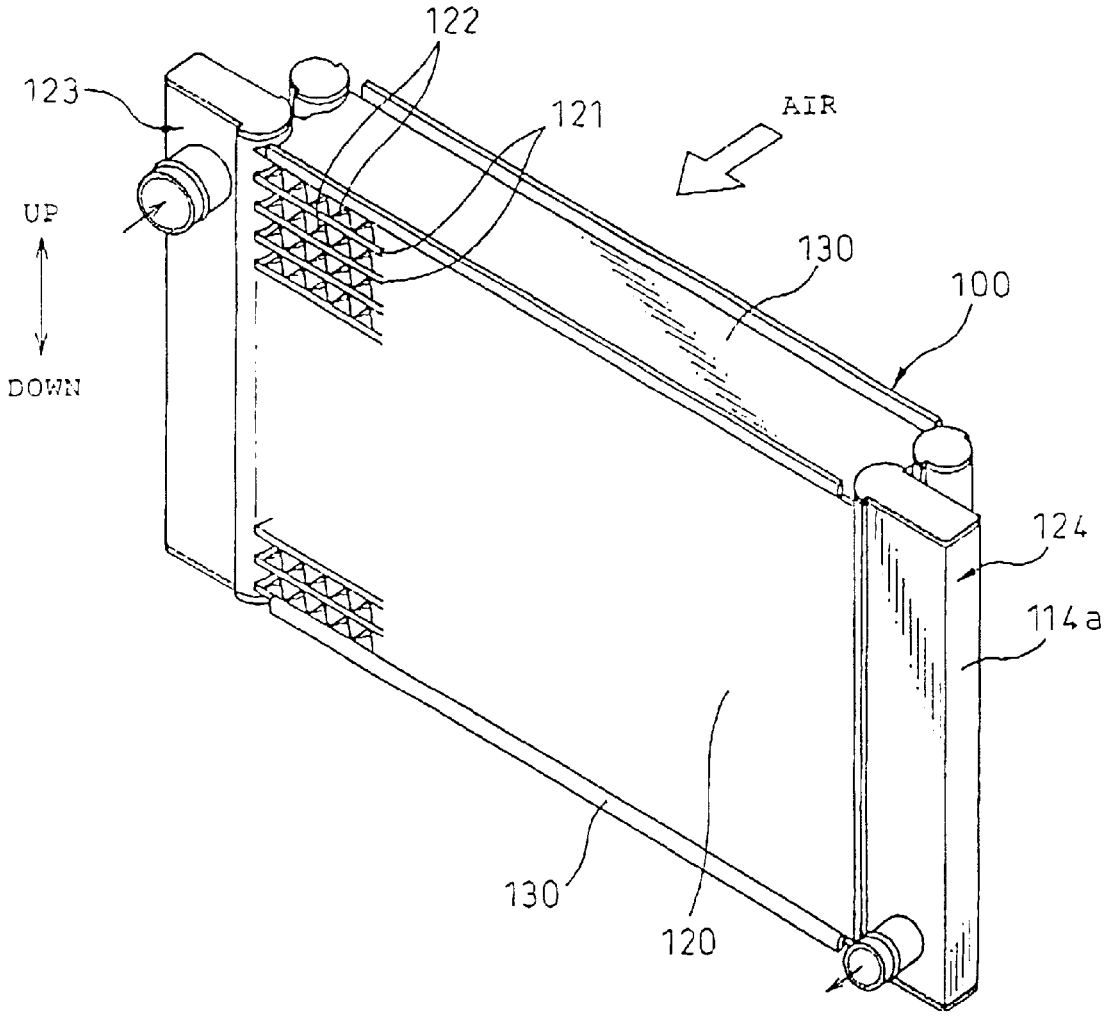
FIG. 2 is a perspective view of the duplex heat exchanger of the first embodiment of the present invention viewed from the downstream side of the airflow.

The first embodiment relates to a duplex heat exchanger, which is a heat exchanger according to the present invention, in which a condenser (radiator, condenser) for a refrigeration cycle system (air conditioner) for a vehicle, and a radiator for cooling the cooling water (cooling liquid) for a water-cooled engine (liquid-cooled internal combustion engine). FIG. 1 is a perspective view of the duplex heat exchanger 100 of the first embodiment viewed from the upstream side of the airflow. FIG. 2 is a perspective view from the water-cooled engine side (downstream side of the airflow). The condenser and the radiator are arranged in series in the direction of airflow so that the condenser is positioned on the upstream side of the radiator.

In FIG. 1, reference numeral 110 denotes a condenser (first heat exchanger) for conducting heat-exchange between the refrigerant circulating in the refrigeration cycle system and air to cool the refrigerant. The condenser 110 comprises a plurality of condenser tubes 111 in which the refrigerant (first fluid) flows, condenser fins (first fins) 112 which are provided on the outer surface between each two condenser tubes 111 to accelerate the heat exchange between the refrigerant and the air, header tanks 113 and 114 which are arranged at the both ends in the longitudinal direction of the condenser tubes 111 and are connected to the condenser tubes 111, etc.

The header tank 113 at the right side in the figure supplies and distributes the refrigerant to each condenser tube 111, and the header tank 114 at the left side in the figure collects the refrigerant after heat exchanging in each condenser tube 111.

Figure 4A:
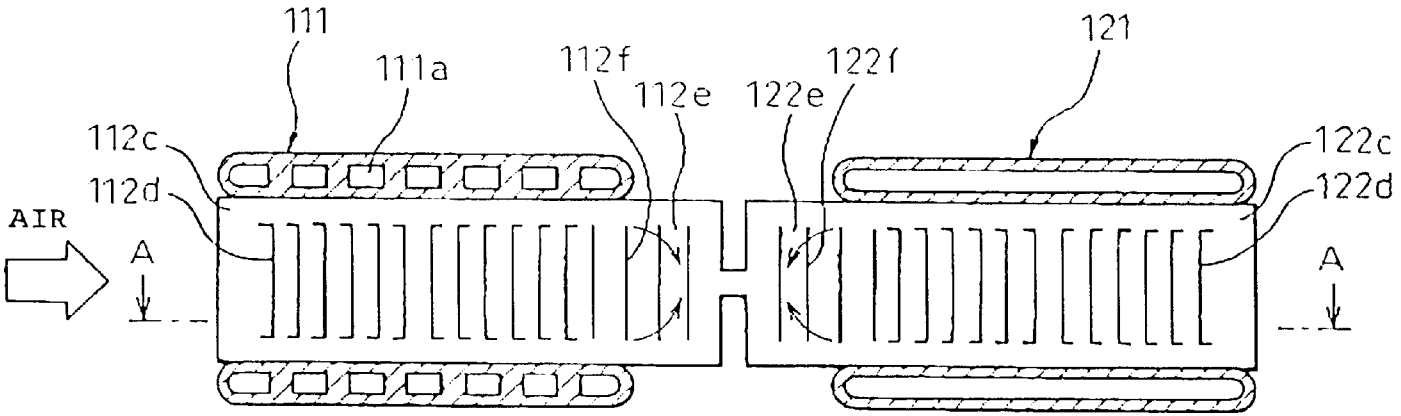
FIG. 4A is a cross-sectional view of the core part of the duplex heat exchanger of the first embodiment of the present invention.

The condenser tubes 111 are of a multi-hole structure in which many refrigerant paths 111*a* are formed, and are formed flat in the manner of extrusion work or drawing work, as shown in FIG. 4A. The condenser fins 112 are integrated with the after-mentioned radiator fins 122, and the details are discussed later.

In FIG. 2, reference numeral 120 denotes a radiator for conducting heat-exchange between the cooling water flowing out from the water-cooled engine and air to cool the cooling water. The radiator 120 comprises a plurality of radiator tubes 121 in which cooling water (second fluid) flows, radiator fins (second fins) 122 which are provided between each two condenser tubes 111 to accelerate the heat exchange between the cooling water and air, header tanks 123 and 124 which are arranged at the both ends in the longitudinal direction of the radiator tubes 121 and are connected to each radiator tube 121, etc.

The reference numeral 130 denotes a side-plate which is arranged at the end of the condenser 110 and the radiator 120 to reinforce both of the condenser 110 and the radiator 120. The tubes 111 and 121, the fins 112 and 122, the header tanks 113, 114, 123, and 124, and the side-plates 130 are integrated by soldering.

The fins 112, 122 are discussed below.

Figure 3:
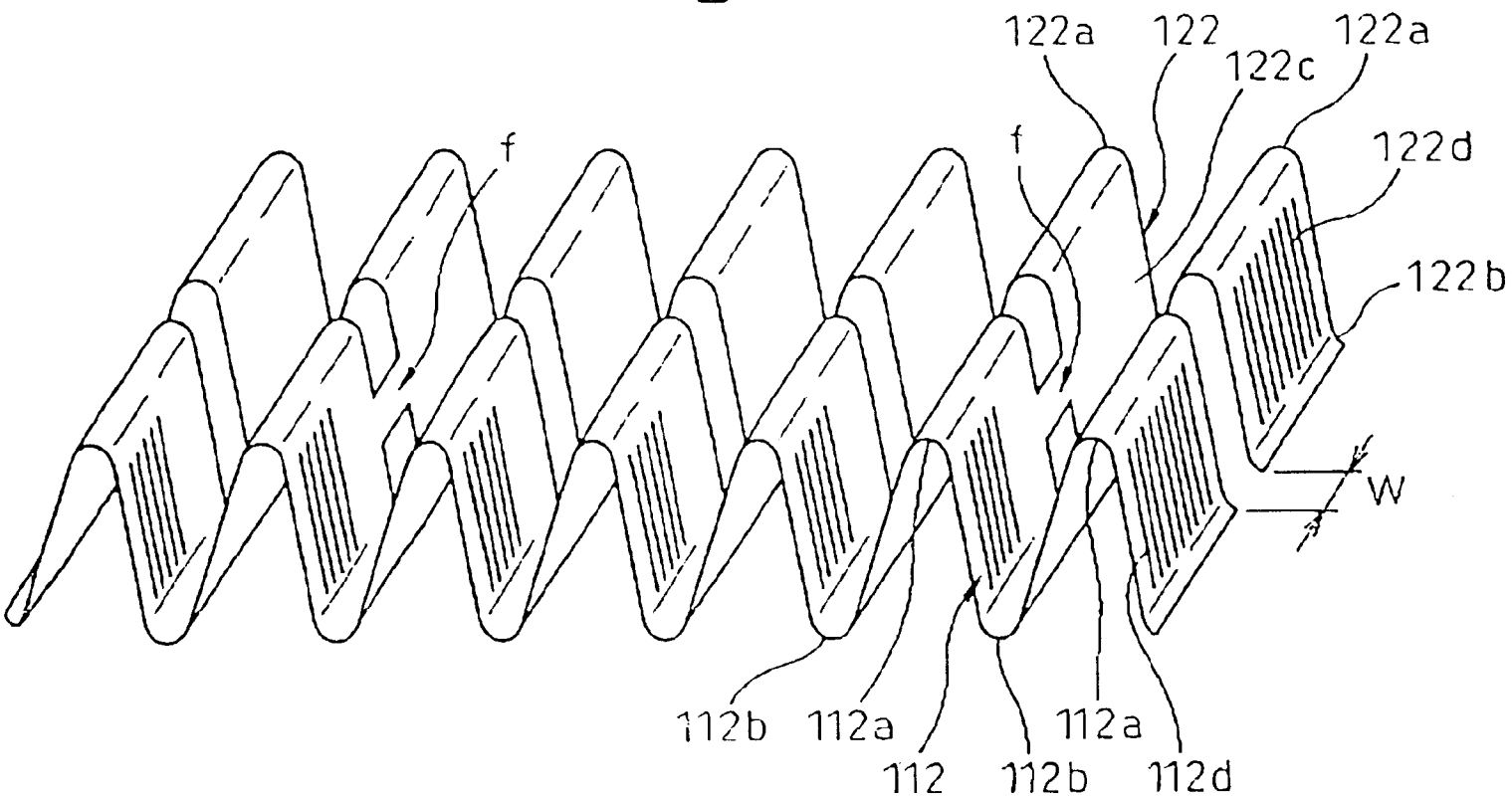
FIG. 3 is a perspective view of the fin of the duplex heat exchanger of the first embodiment of the present invention.

The fins 112, 122 are formed in a single piece by a roller forming method as shown in FIG. 3, and are wave form corrugated fins consisting of a plurality of crest portions 112*a*, 122*a*, trough portions 112*b*, 122*b*, and flat portions 112*c*, 122*c* which connect adjacent crest portions 112*a*, 122*a*, and trough portions 112*b*, 122*b*.

Figure 4B:
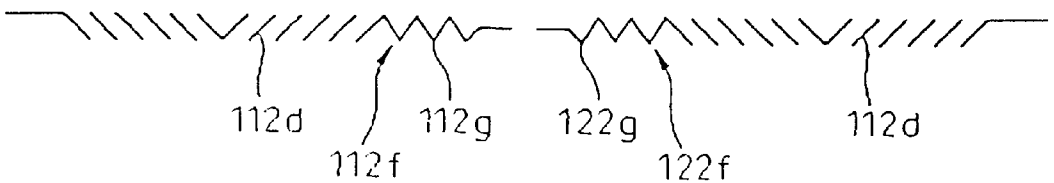
FIG. 4B is a cross-sectional view of the core part along the line A—A shown in FIG. 4A.

On the flat portions 112*c*, 122*c*, the louvers 112*d*, 122*d* are formed in louver board style by cutting and setting up part of the flat portions 112*c*, 122*c* to disturb the airflow passing through the fins 112, 122 to prevent growth of a temperature boundary layer. As shown in FIGS. 4A and 4B, connecting portions f are provided at intervals of a plurality of crest portions to connect the fins 112 and 122 so as to keep a distance of more than predetermined length W between the condenser fin 112 and the radiator fin 122.

The predetermined length W is at least more than the thickness of the fin 112 or 122, and a slit (space) S which is provided by keeping a distance of more than predetermined length w between the condenser fin 112 and the radiator fin 122 functions as a heat transfer suppressing means for suppressing the heat transfer from the radiator 120 side to the condenser 110 side.

Furthermore, on the radiator tube 121 side of the condenser fin 112, a protrusion portion 112*e* is provided which protrudes from an end of the condenser tube 111 in the width direction of the tube to the radiator tube 121, in the direction perpendicular to the longitudinal direction of the condenser tube 111. On the condenser tube 111 side of the radiator fin 122, a protrusion portion 122*e* is provided which protrudes from an end of the radiator tube 121 in the width direction of the tube to the condenser tube 111, in the direction perpendicular to the longitudinal direction of the radiator tube 121.

Figure 5:
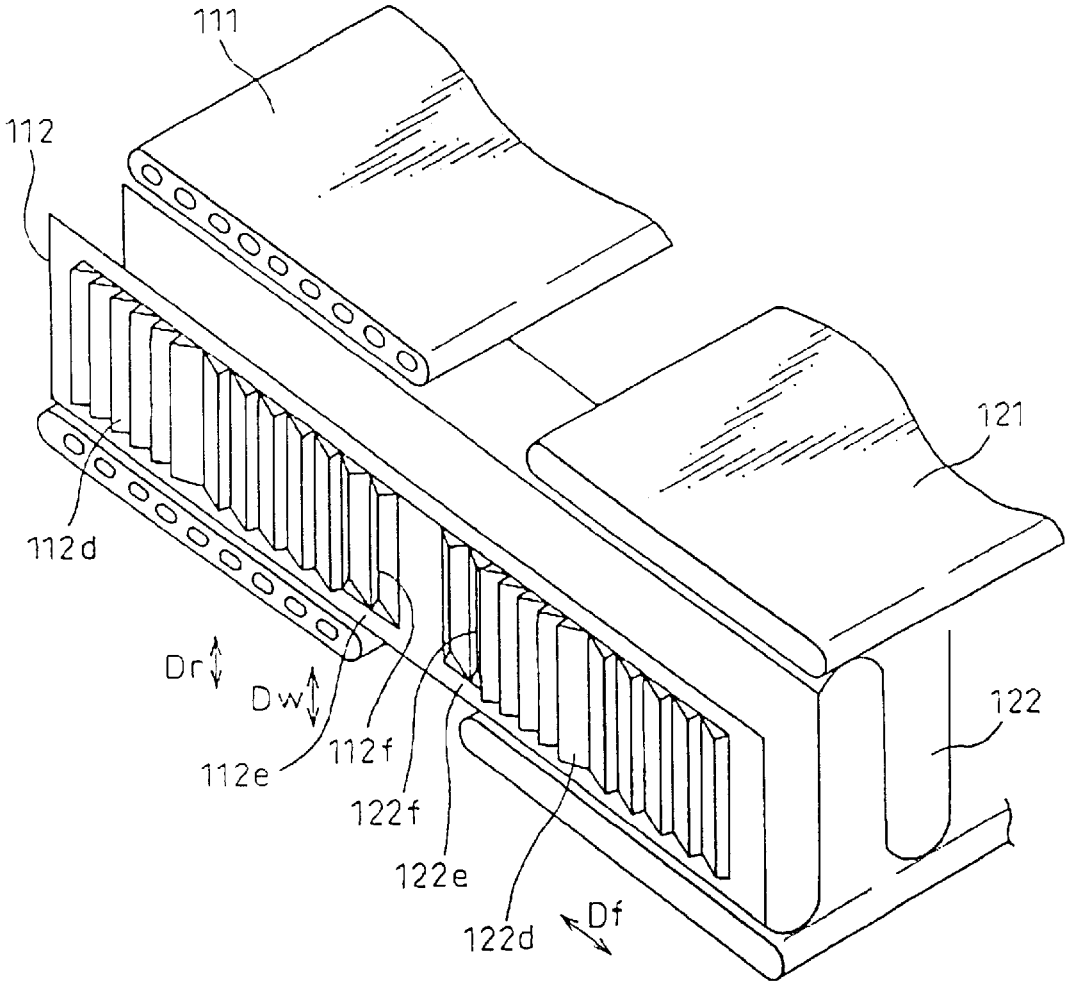
FIG. 5 is a perspective view of the core part of the duplex heat exchanger of the first embodiment of the present invention.

In addition, as shown in FIG. 5, on the protrusion portions 112*e*, 122*e*, uneven portions 112*f*, 122*f* are formed in wave form in the manner of plastic deformation by a roller forming machine without cutting part of the protrusion portions 112*e*, 122*e* to increase the surface area of the fins 112, 122. The uneven portions 112*f*, 122*f* are also formed so that the ridge direction Dw of the uneven portions 112*f*, 122*f* is substantially parallel with a cutting direction Dr of the louvers 112*d*, 122*d*.

The ridge direction Dw of the protrusion portions 112*f*, 122*f* is the direction ranging the summits of the crest portions 112*g*, 122*g* (see FIG. 4B) of the wave form uneven portions 112*f*, 122*f*, and the cutting direction Dr of the louvers 112*d*, 122*d* is the direction substantially perpendicular to the ridge direction Df ranging the summits of the crest portions 112*a*, 122*a* of the fins 112, 122.

Below are described advantages of this embodiment.

According to this embodiment, the uneven portions 112*f*, 122*f* are provided on the protrusion portions 112*e*, 122*e* without cutting part of the protrusion portions 112*e*, 122*e*, and thereby the surface area of the protrusion portions 112*e*, 122*e* may be increased without decreasing the thermal conductive area of the fins extending to the end of the protrusion portions 112*e*, 122*e*.

For this reason, a sufficient amount of heat (arrow marks in FIG. 4A) may be conducted from the tubes 111, 121 to the fins 112, 122 (especially to the protrusion portions 112*e*, 122*e*), and the improvement in radiation ability appropriate to the increase in radiation area may be achieved accordingly.

In addition, the uneven portions 112*f*, 122*f* do not disturb the airflow as much as the louver 112*d*, 122*d* because the uneven portion 112*f*, 122*f* are not formed by cutting part of the fins in contrast to the louvers 112*d*, 122*d*, thereby decreasing the airflow resistance more than the louvers.

Although the heat transfer coefficient of the protrusion portions 112*e*, 122*e* may be lower than that of the other portions (flat portions 112*c*, 122*c*) or the protrusion portion 112*e*, 122*e*, on which the louvers 112*d*, 122*d* are provided, the surface area of the protrusion portions 112*e*, 122*e* is increased without decreasing the thermal conductive area of the protrusion portions 112*e*, 122*e*, and the air volume is increased due to the decrease of airflow resistance, and thereby the radiation ability may be improved.

In addition, since the uneven portions 112*f*, 122*f* are also formed so that the ridge direction Dw of the uneven portions 112*f*, 122*f* is substantially parallel with a cutting direction Dr of the louvers 112*d*, 122*d*, the ridge direction Dw and the cutting direction Dr are both substantially perpendicular to the fin material moving direction of the roller forming machine, and thereby the uneven portions 112*f* and 122*f*, and the louvers 112*d* and 122*d* may be formed without using a special roller forming machine. For this reason, productivity of the fins 112 and 122 may be improved, and production cost of the fins 112 and 122 (the duplex heat exchanger 100) may be reduced accordingly.

The Second Embodiment

Figure 6:
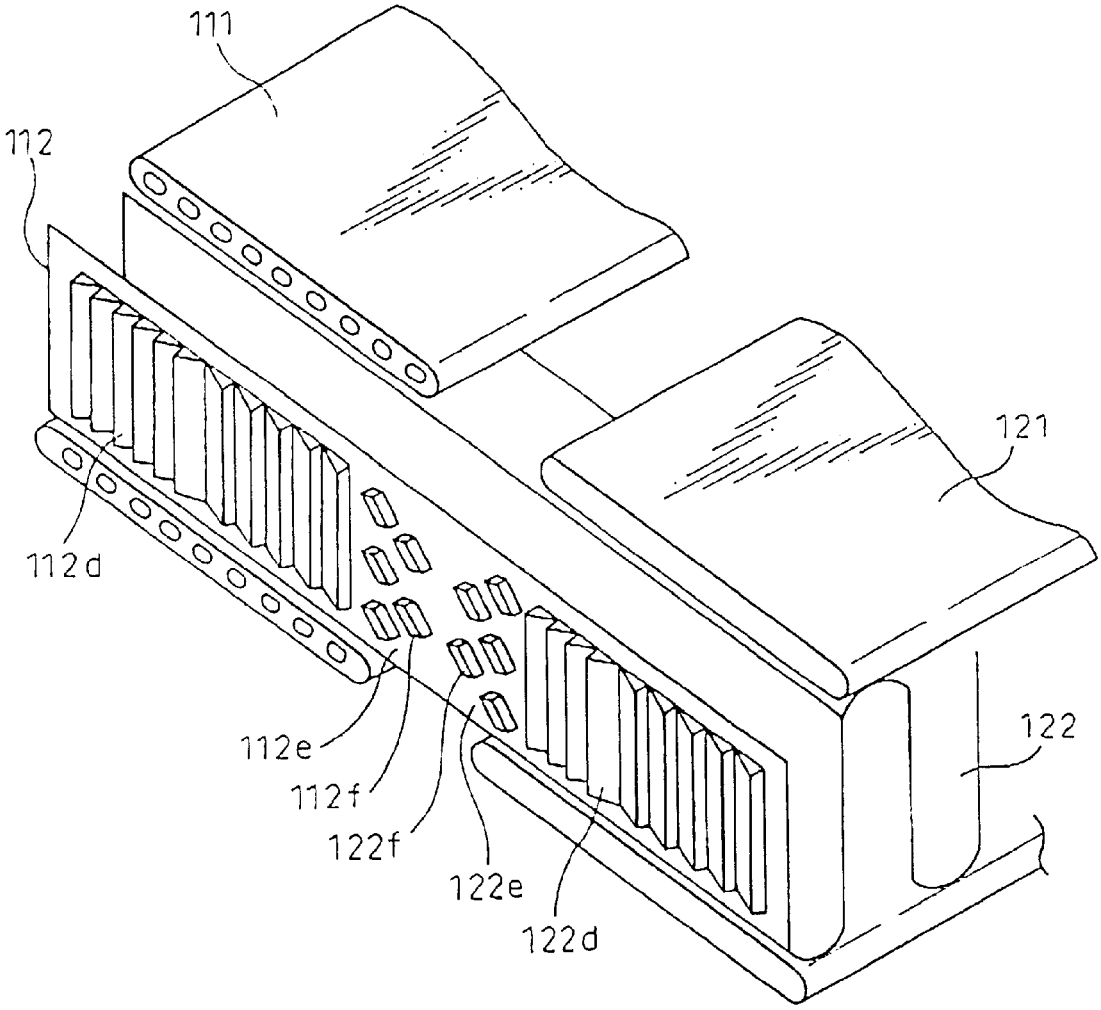
FIG. 6 is a perspective view of the core part of the duplex heat exchanger of the second embodiment of the present invention.

In the first embodiment, the uneven portions 112*f* and 122*f* are formed in a wave form, but in this embodiment, the uneven portions 112*f* and 122*f* are formed with dice-formed unevenness (dimples) as shown in FIG. 6.

The Third Embodiment

In the above embodiments, the uneven portions 112*f*, 122*f* are formed on the protrusion portions 112*e*, 122*e* without cutting part of the protrusion portions 112*e*, 122*e*. But in this embodiment and after-mentioned embodiments, the uneven portions 112*f*, 122*f* are not provided, but dimensions of lovers (called protrusion portion louvers 112*d*, 122*d* hereinafter) formed on the protrusion portions 112*e*, 122*e* are different from dimensions of louvers (called flat portion louvers 112*d*, 122*d* hereinafter) formed on the other portions than the protrusion portion 112*e*, 122*e*.

Figure 7:
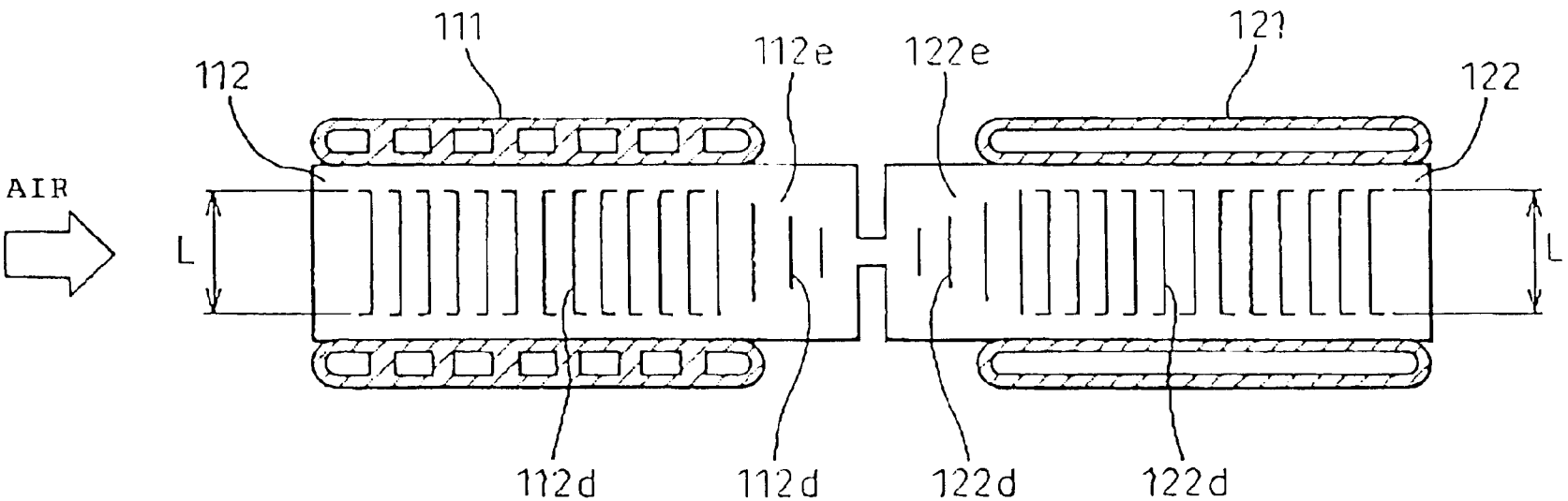
FIG. 7 is a perspective view of the core part of the duplex heat exchanger of the third embodiment of the present invention.

More specifically, the cutting length L of the protrusion portion louvers 112*d*, 122*d* is determined to be decreased with increasing proximity to the protrusion end of the protrusion portions 112*e*, 122*e* as shown in FIG. 7.

Thus, the airflow resistance of the protrusion portion louvers 112*d*, 122*d* may be reduced, and thereby the improvement in radiation ability appropriate to the increase in radiation area may be achieved.

Since the temperature difference between the fin and air is generally decreased with increasing proximity to the fin end (the portion farthest from the tube) regardless of the presence or absence of the louver, cooling efficiency of the fin is decreased with increasing proximity to the fin end. Therefore, in this embodiment, the airflow resistance is reduced by decreasing the cutting length L of the protrusion portion louver 112*d*, 122*d* at the end of the protrusion portion 112*e*, 122*e* where the cooling efficiency is very low.

The Fourth Embodiment

Figure 8:
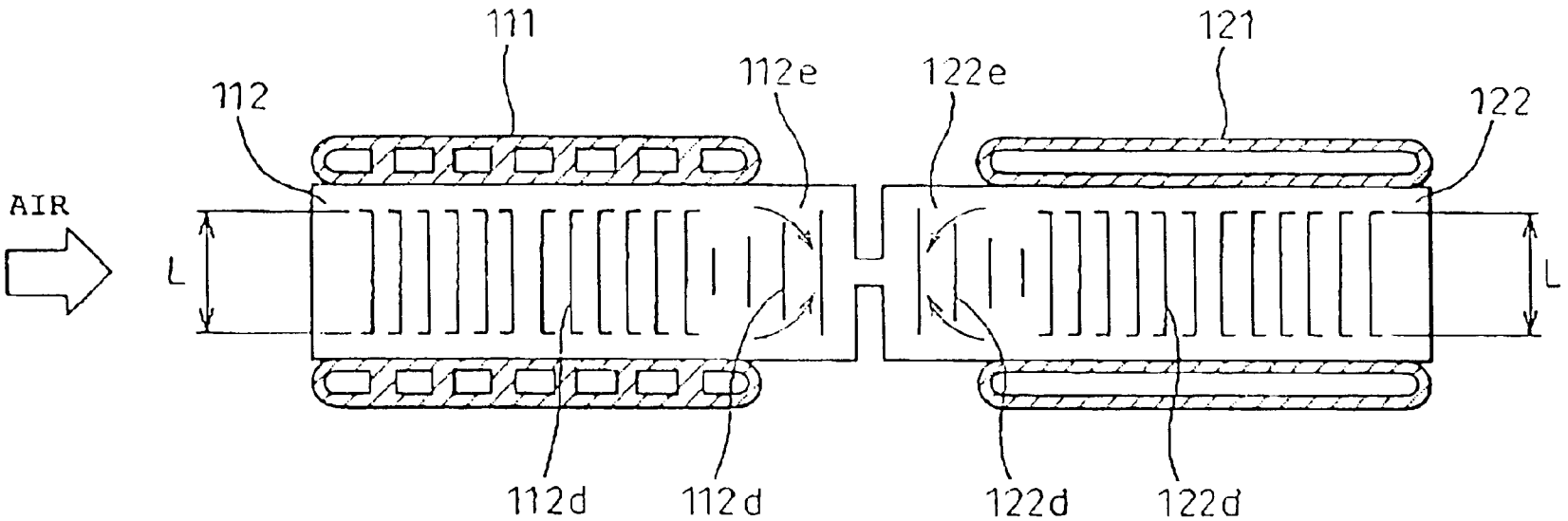
FIG. 8 is a perspective view of the core part of the duplex heat exchanger of the fourth embodiment of the present invention.

In this embodiment, cutting length L of the protrusion portion louver 112*d*, 122*d* is determined to be increased with increasing proximity to the protrusion end of the protrusion portion 112*e*, 122*e* as shown in FIG. 8.

Thus, the airflow resistance of the protrusion portion louver 112*d*, 122*d* may be reduced, and the radiation ability may be improved accordingly.

In addition, the cutting length L at the basal portion side (tube 111, 121 side) of the protrusion portions 112*e*, 122*e* having high cooling efficiency is decreased to increase the thermal conductive area, and thereby sufficient amount of heat may be conducted to the basal portion side of the protrusion portions 112*e*, 122*e* having high cooling efficiency. For this reason, the improvement in radiation ability appropriate to the increase in radiation area may be surely achieved.

The Fifth Embodiment

Figure 9:
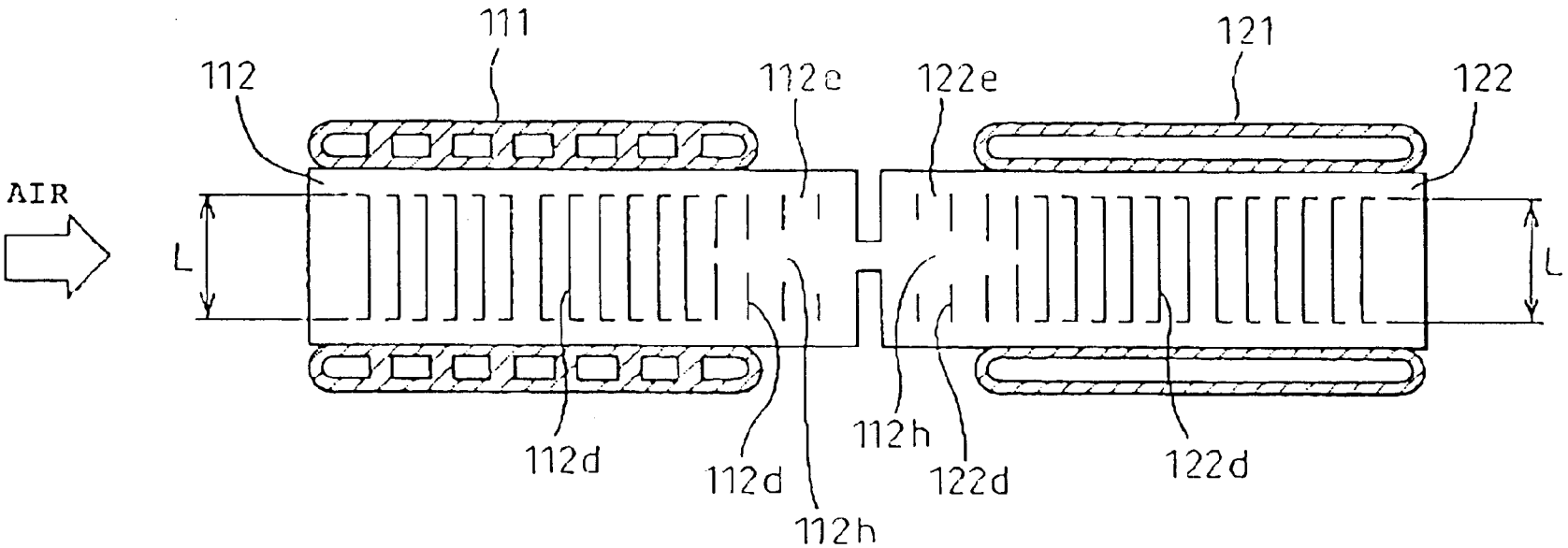
FIG. 9 is a perspective view of the core part of the duplex heat exchanger of the fifth embodiment of the present invention.

In this embodiment, as shown in FIG. 9, in the region on the protrusion portion 112*e*, 122*e*, corresponding to the main flow path of the air flowing between tubes 111, 121, i.e. the region which is substantially at the center of the protrusion portion 112*e*, 122*e* and is substantially parallel to the airflow, the flat portion 112*h*, 122*h* is provided on which protrusion portion louvers 112*d*, 122*d* are not formed.

Thus, the airflow resistance of the region corresponding to the main flow having large flow rate may be reduced, and thereby airflow resistance may be reduced effectively, and the improvement in radiation ability appropriate to the increase in radiation area may be achieved accordingly.

As shown in FIG. 9, the flat portions 112*h*, 122*h* are provided so that the cutting length L of the protrusion portion louvers 112*d*, 122*d* is increased with increasing proximity to the protrusion end of the protrusion portions 112*e*, 122*e* as shown in FIG. 9, but the flat portion 112*h*, 122*h* may be provided so that the cutting length L of the protrusion portion louvers 112*d*, 122*d* is decreased with increasing proximity to the protrusion end of the protrusion portions 112*e*, 122*e*.

The Sixth Embodiment

Figure 10A:
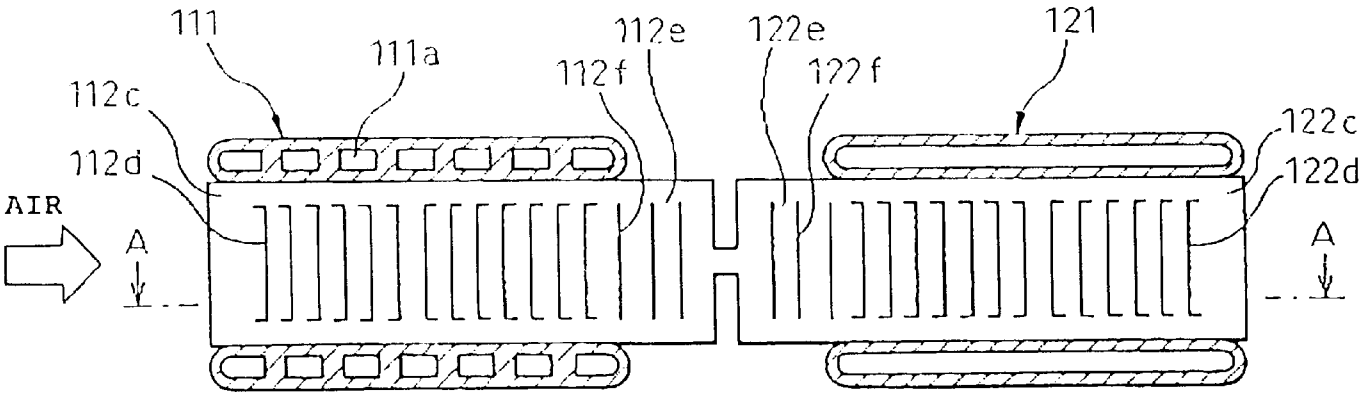
FIG. 10A is a cross-sectional view of the core part of the duplex heat exchanger of the sixth embodiment of the present invention.
Figure 10B:
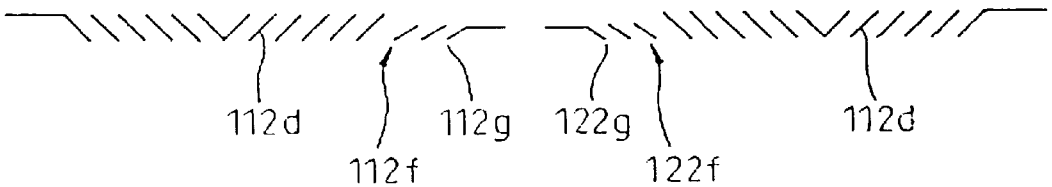
FIG. 10B is a cross-sectional view of the core part along the line A—A shown in FIG. 10A.
Figure 11A:
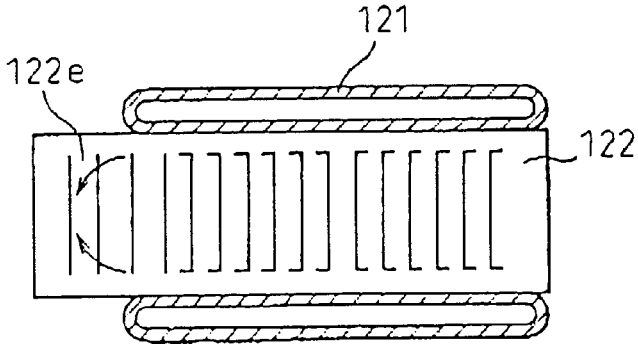
FIG. 11A is a cross-sectional of the core part of the duplex heat exchanger of a variation of the present invention.
Figure 11B:
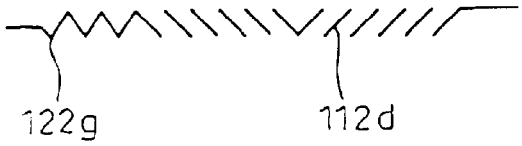
FIG. 11B is a cross-sectional view of the fin shown in FIG. 11A.
Figure 11C:
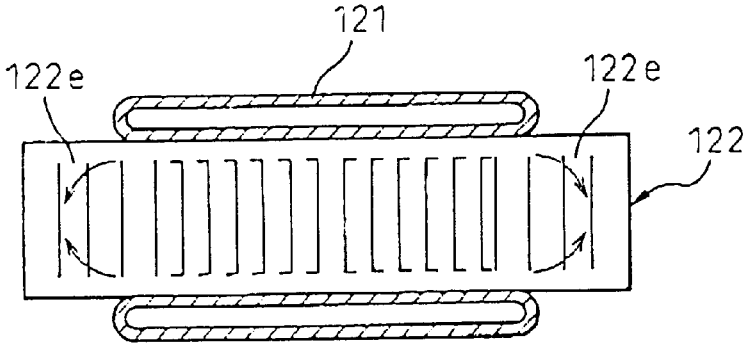
FIG. 11C is a cross-sectional of the core part of the duplex heat exchanger of another variation of the present invention.
Figure 11D:
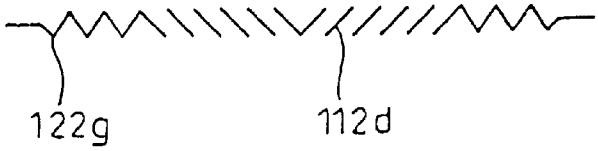
FIG. 11D is a cross-sectional view of the fin shown in FIG. 11C.

In this embodiment, the cutting angle β of the protrusion portion louvers 112*d*, 122*d* is determined to be decreased with increasing proximity to the protrusion end of the protrusion portions 112*e*, 122*e* as shown in FIG. 10B.

The cutting angle β of the protrusion portion louvers 112*d*, 122*d* is an angle between the protrusion portion louvers 112*d*, 122*d* formed by cutting and setting up part of the flat portions and the flat portions 112*c*, 122*c*. β=0 means that a louver is not formed.

Thus the airflow resistance of the protrusion portion louvers 112*d*, 122*d* may be reduced, and thereby the improvement in radiation ability appropriate to the increase in radiation area may be achieved.

Other Embodiments

The heat exchanger of the aforementioned embodiment is a duplex heat exchanger in which a condenser and a radiator are integrated but the present invention may also provide a single heat exchanger such as a condenser or a radiator.

For example, FIG. 11A~11D show a radiator to which the spirit of the first embodiment of the present invention is implemented. It is apparent from FIG. 11C that protrusion portion 122*e* of the fin 122 may be provided at both side ends of the fin 122.

As described above, the present invention is described based on the particular embodiments, however, it will be understood by those skilled in the art that the embodiments may be subject to numerous adaptations and modifications without departing from the scope and spirit of the invention.

What is claimed is:

1. A heat exchanger assembly comprising a first heat exchanger having a plurality of first tubes in which a first fluid flows and which extend in a direction perpendicular to the direction of airflow, and first fins which are provided on the outer surface of the first tubes to accelerate the heat exchange between air and the first fluid, wherein the first fins have first protrusion portions protruded from an end of the first tubes in the width direction of the first tubes to the direction perpendicular to the longitudinal direction of the first tubes, and first uneven portions are formed on the first protrusion portions without cutting part of the first protrusion portions to increase the surface area of the first fins;

a second heat exchanger arranged in series with the first heat exchanger in the direction of airflow, the second heat exchanger having a plurality of second tubes in which a second fluid flows and which extend in the direction perpendicular to the direction of airflow, and second fins which are provided on the outer surface of the second tubes to accelerate the heat exchange between air and the second fluid, wherein the second fins have second protrusion portions protruded from an end of the second tubes in the width direction of the second tubes, wherein the first protrusion portions of the first heat exchanger are protruded toward the second heat exchanger, and the second protrusion portions of the second heat exchanger are protruded toward the first heat exchanger wherein:

louvers are formed in louver board style by cutting and setting up part of the first fins on the portions other than the first uneven portions of the first fins;

the first uneven portions are formed in a wave form, and a ridge direction ranging over the summits of the crest portions of the first uneven portions is substantially parallel with a cutting direction of the louvers; and the first tubes and the first fins are stacked alternately with each other.

2. The heat exchanger assembly of claim 1, wherein the first fins of the first heat exchanger and the second fins of the second heat exchanger are integrated.

3. The heat exchanger assembly of claim 2, wherein a heat transfer suppressing means (S) for suppressing the heat transfer is provided between the first fins of the first heat exchanger and the second fins of the second heat exchanger.

4. The heat exchanger assembly of claim 1 wherein a plurality of second uneven portions are formed on the first fins.

5. The heat exchanger assembly of claim 1 wherein the first fins are wave form corrugated fins.

* * * * *